US009129735B2

(12) United States Patent
Tsuchiya et al.

(10) Patent No.: US 9,129,735 B2
(45) Date of Patent: Sep. 8, 2015

(54) TRANSFORMER AND METHOD FOR MANUFACTURING CASE OF THE TRANSFORMER

(71) Applicants: Junichirou Tsuchiya, Odawara (JP); Akihiko Souda, Fujisawa (JP)

(72) Inventors: Junichirou Tsuchiya, Odawara (JP); Akihiko Souda, Fujisawa (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 0 days.

(21) Appl. No.: 14/131,993

(22) PCT Filed: Oct. 18, 2012

(86) PCT No.: PCT/JP2012/076973

§ 371 (c)(1),
(2) Date: Jan. 10, 2014

(87) PCT Pub. No.: WO2014/041707

PCT Pub. Date: Mar. 20, 2014

(65) Prior Publication Data

US 2014/0327507 A1 Nov. 6, 2014

(30) Foreign Application Priority Data

Sep. 11, 2012 (JP) ..... 2012-199573

(51) Int. Cl.

| | |
|---|---|
| ***H01F 27/02*** | (2006.01) |
| ***H01F 27/24*** | (2006.01) |
| ***H01F 30/00*** | (2006.01) |
| ***H01F 41/00*** | (2006.01) |

(52) U.S. Cl.

CPC ..... *H01F 27/02* (2013.01); *H01F 27/025* (2013.01); *H01F 30/00* (2013.01); *H01F 41/00* (2013.01); *H01F 41/005* (2013.01); *Y10T 29/4902* (2015.01)

(58) Field of Classification Search

CPC ..... H01F 38/12
USPC ..... 336/83, 90
See application file for complete search history.

(56) References Cited

U.S. PATENT DOCUMENTS

| | | | | |
|---|---|---|---|---|
| 8,736,411 | B2 * | 5/2014 | Yen | 336/59 |
| 2012/0139684 | A1 * | 6/2012 | Kobayashi et al. | 336/92 |
| 2013/0038415 | A1 * | 2/2013 | Ooishi et al. | 336/61 |

FOREIGN PATENT DOCUMENTS

| | | | |
|---|---|---|---|
| JP | 09-069452 | A | 3/1997 |
| JP | 2008-153293 | A | 7/2008 |
| JP | 2010-034228 | A | 2/2010 |

OTHER PUBLICATIONS

Office Action issued Apr. 2, 2013 in corresponding Japanese Application No. 2012-199573, including English translation, 3 pages.
International Search Report dated Jan. 29, 2013 from International Application No. PCT/JP2012/076973, 2 pages.

* cited by examiner

*Primary Examiner* — Elvin G Enad
*Assistant Examiner* — Ronald Hinson
(74) *Attorney, Agent, or Firm* — Fish & Richardson P.C.

(57) ABSTRACT

A transformer includes an input-side primary coil, an output-side secondary coil, a core around which the primary and secondary coils are coiled, a casting case housing a transformer body provided by the primary and secondary coils and the core, and a mold resin filling a clearance between the case and the transformer body. The case includes a bottom portion attached with the transformer body, a side wall surrounding the bottom portion, and an opening provided opposite to the bottom portion, the transformer body being housed and the mold resin being filled through the opening. A thickness of a mold layer provided in the clearance between an inner wall surface of the side wall and an outer surface of the transformer body opposed to the inner wall surface is constant for a predetermined length from a point at or near the opening of the case toward the bottom portion.

7 Claims, 8 Drawing Sheets

TRANSFORMER AND METHOD FOR MANUFACTURING CASE OF THE TRANSFORMER

CROSS-REFERENCE TO RELATED APPLICATIONS

This application claims priority to International Application No. PCT/JP2012/076973 filed on Oct. 18, 2012, which application claims priority to Japanese Application No. 2012-199573, filed on Sep. 11, 2012. The contents of the above applications are incorporated herein by reference in their entireties.

TECHNICAL FIELD

The present invention relates to a transformer and a method for manufacturing a case of the transformer. Specifically, the invention relates to a transformer including a casting case that houses primary and secondary coils and a core around which the coils are coiled, and a method for manufacturing the case used in the transformer.

BACKGROUND ART

Transformers include a primary coil to which power is input, a secondary coil from which power is output and a core (iron core) around which the primary and secondary coils are coiled to be magnetically coupled. The relative positions of the primary and secondary coils and the core of, for instance, a boosting transformer are of great significance and have to be accurately maintained in order to stably obtain a predetermined inductance performance (magnetic coupling degree) required for a boost operation. Further, the primary and secondary coils and the core have to be mutually insulated and have to be efficiently cooled because the primary and secondary coils and the core sometimes generate heat due to electric loss and magnetic loss during the boost operation (i.e. when being energized). When the above requirements are not met, the transformer may sometimes be inoperative. Further, in case of insufficient cooling, an operative range capable of stable boosting may be narrowed.

Accordingly, as disclosed in Patent Literature 1, a typical transformer includes a plate piece made of a composite material of glass and epoxy (usually referred to as glass epoxy) of a predetermined thickness inserted between the primary and secondary coils and the core. A similar plate piece is inserted between the primary and secondary coils. When a transformer is assembled, a sub-assembly in which the mutual positions of the primary and secondary coils and the core are accurately held is initially made and a thermosetting fluid resin (referred to as a mold resin hereinafter) is put into a case housing the sub-assembly, which is thermally cured to completely hold the relative positions of the primary and secondary coils and the core. The mold resin is also required for preventing loss of insulating function due to invasion of foreign substances or moisture into the case.

It should be noted that the case in which the sub-assembly is housed is connected to a heat sink via a screw and the like, where the heat generated by the sub-assembly is transmitted to the heat sink to be radiated. Accordingly, the case preferably has good thermal conductivity and thus is made of aluminum casting. Further, since the core is the component of the sub-assembly that is adapted to be brought into contact with the case with the largest area in view of the magnetic properties, the bottom side of the core is made to be a flat surface and a core-contacting surface facing the flat surface is also made flat. Since the flat surfaces are closely contacted, the heat of the sub-assembly is efficiently transferred from the core to the case and is radiated via the heat sink without impairing the magnetic properties.

CITATION LIST

Patent Literature(s)

Patent Literature 1 JP-A-2008-153293

SUMMARY OF THE INVENTION

Problem(s) to be Solved by the Invention

However, in the transformer disclosed in Patent Literature 1, a lower surface of the case (i.e. a lower surface at the bottom of the case defining the core mount surface) is connected to the heat sink, while the heat generated by the sub-assembly is effectively radiated from below, the heat transfer to the case is blocked at a part other than the lower surface of the case due to the presence of the mold resin fed between the sub-assembly and the case, thereby causing insufficient cooling. In other words, the material of the mold resin is generally small in heat conductivity as compared to a metal material and thus is poor in heat transfer performance. Especially, when a case of which upper side is opened is provided by casting, since a draft is defined on an inner surface of the case so that the case is thinned from the core mount surface on the bottom side toward the opening on the upper side, due to the shape of a mold core used for casting the case, a layer of the mold resin provided between the core and the inner surface of the case (referred to as a mold layer hereinafter) becomes thick toward the upper side. While the temperature becomes higher toward the upper side due to the presence of the heat sink at the lower side, the mold layer becomes thicker toward the upper side of the case, which is disadvantageous for cooling by heat radiation.

An object of the invention is to provide a transformer that is excellent in heat radiation performance and a method for manufacturing a case thereof.

Means for Solving the Problem(s)

A transformer according to a first aspect of the invention includes: a primary coil to which power is input; a secondary coil from which the power is output; a core around which the primary and secondary coils are coiled; a casting case that houses a transformer body provided by the primary and secondary coils and the core; and a mold resin filling a clearance between the case and the transformer body, in which the case includes: an attachment face portion on which the transformer body is attached; a side wall surrounding the attachment face portion; and an opening provided at a position opposed to the attachment face portion, the transformer body being housed and the mold resin being supplied through the opening, and a thickness of a mold layer provided in the clearance between an inner wall surface of the side wall and an opposed surface of the transformer body closely opposed to the inner wall surface is constant for a predetermined length from a point at or near the opening of the case toward the attachment face portion.

It should be noted that, though the above Patent Literature 1 schematically illustrating a structure of a transformer seemingly discloses an arrangement similar to that of the above first aspect of the invention, it is based on a technical idea unique to the invention to find a problem associated with the use of a casting case and to create the above solution for solving the problem, which is different from the invention disclosed in Patent Literature 1 and cannot be easily conceived based on the invention disclosed in Patent Literature 1.

In a transformer according to a second aspect of the invention, a casting surface on an inner surface of the attachment face portion is cut to provide a core mount surface with a predetermined surface roughness, the core being adapted to be in contact with the core mount surface.

In a transformer according to a third aspect of the invention, a casting surface on an outer surface of the attachment face portion is cut to provide a contact surface with a predetermined surface roughness, the contact surface being adapted to be in close contact with a radiator.

In a transformer according to a third aspect of the invention, the case is manufactured by a process including: manufacturing a mold core with a use of a mold-core-production die having a cavity surface corresponding to the attachment face portion of the case and a separation surface in a direction orthogonal to the cavity surface; and casting to provide the case using the mold core manufactured in the manufacturing of the mold core.

In a method for manufacturing a case of a transformer according to a fifth aspect of the invention, the transformer includes: a primary coil to which power is input; a secondary coil from which the power is output; a core around which the primary and secondary coils are coiled; a casting case that houses a transformer body provided by the primary and secondary coils and the core; and a mold resin filling a clearance between the case and the transformer body, wherein the case comprises: an attachment face portion on which the transformer body is attached; a side wall surrounding the attachment face portion; and an opening provided at a position opposed to the attachment face portion, the transformer body being housed and the mold resin being supplied through the opening, a thickness of a mold layer provided in the clearance between an inner wall surface of the side wall and an opposed surface of the transformer body closely opposed to the inner wall surface being constant for a predetermined length from a point at or near the opening of the case toward the attachment face portion, the method including: manufacturing a mold core with a use of a mold-core-production die comprising a cavity surface corresponding to the attachment face portion of the case and a separation surface in a direction orthogonal to the cavity surface; and casting to provide the case using the mold core manufactured in the manufacturing of the mold core.

A method for manufacturing a case of a transformer according to a sixth aspect of the invention includes: machining an inclined casting surface formed on the attachment surface of the case after the casting due to a draft of the mold core to remove the casting surface to provide a predetermined surface roughness.

According to the first aspect of the invention, since the thickness of the case mold layer present between the inner wall of the case and the opposed surface of the transformer body is the same in a range proximate to the opening of the case, the heat transmitted from the core through the mold layer to the case can be equally distributed even at a side remote from the attachment face portion of the case, thereby enhancing the heat radiation performance of the entire transformer.

Accordingly, the "predetermined length" in the above aspect of the invention refers to a length sufficient for substantially equalizing the heat distribution in a region from the opening to the attachment face portion due to the heat transferred to the side wall of the case, which is not necessary to be strictly the same as the actual length from the opening of the case to the attachment face portion, but may be shorter than the actual length.

According to the second, third and sixth aspects of the invention, since the core mount surface or the contact surface of a predetermined surface roughness is provided on the attachment face portion of the case, the attitude of the transformer body attached in the case or the attitude of the case attached to the heat radiator can be favorably set and the above components can be brought into close contact with each other to provide a secure metal touch, so that the efficiency of the heat transfer from the transformer body to the case and from the case to the heat radiator can be enhanced, thereby further enhancing the heat-radiation performance.

In other words, the "predetermined surface roughness" in the above aspects of the invention refers to a surface roughness that ensures the close contact between the components for achieving a favorable heat transfer.

According to the fourth and fifth aspects of the invention, the case without the draft on the side wall can be reliably manufactured, thereby providing a case capable of enhancing the heat radiation performance.

BRIEF DESCRIPTION OF DRAWING(S)

DESCRIPTION OF EMBODIMENT(S)

Figure 1:
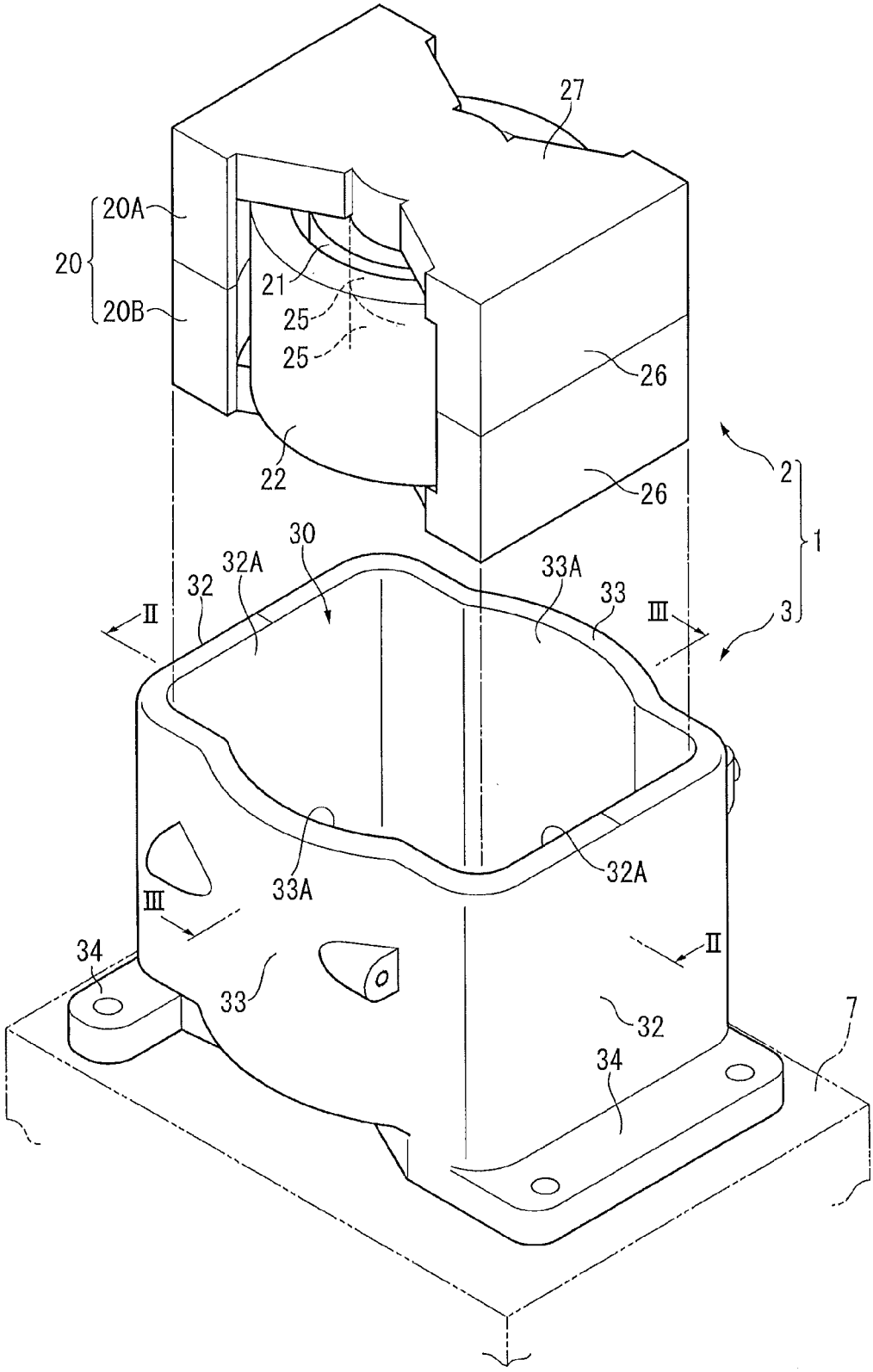
FIG. 1 is an exploded perspective view showing a transformer according to an exemplary embodiment of the invention.

Exemplary embodiment(s) of the invention will be described below with reference to the attached drawings, FIG. 1 shows a partially exploded transformer 1 of the exemplary embodiment.

Figure 2:
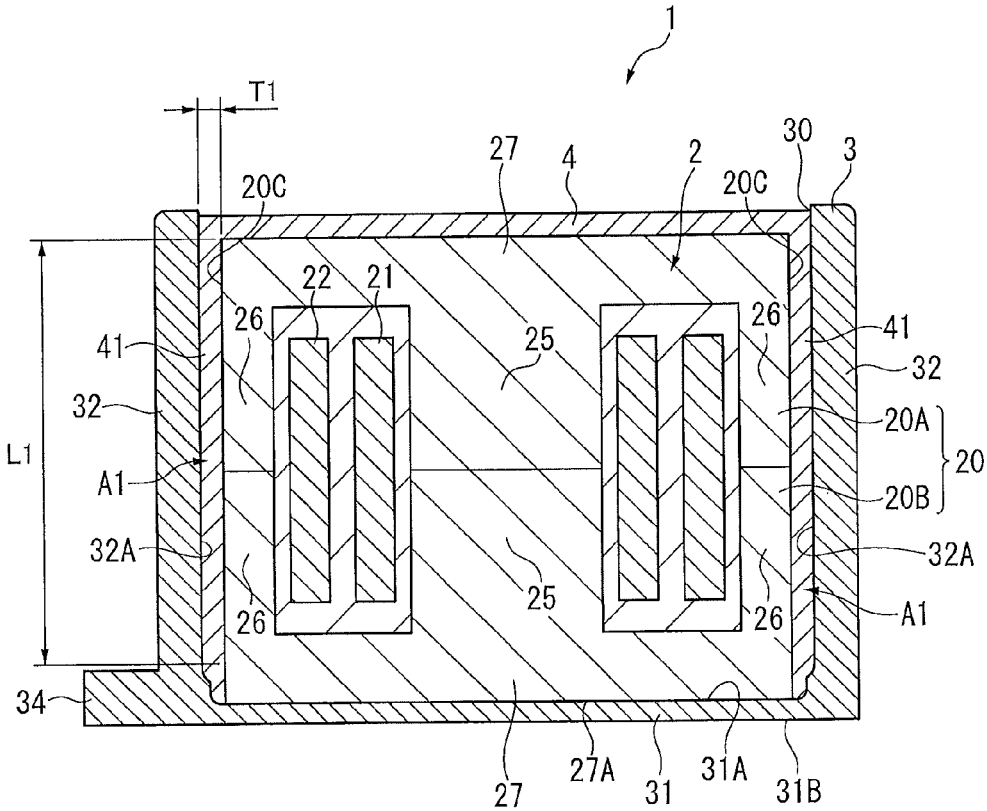
FIG. 2 is a vertical cross section of the transformer taken along line in FIG. 1.
Figure 3:
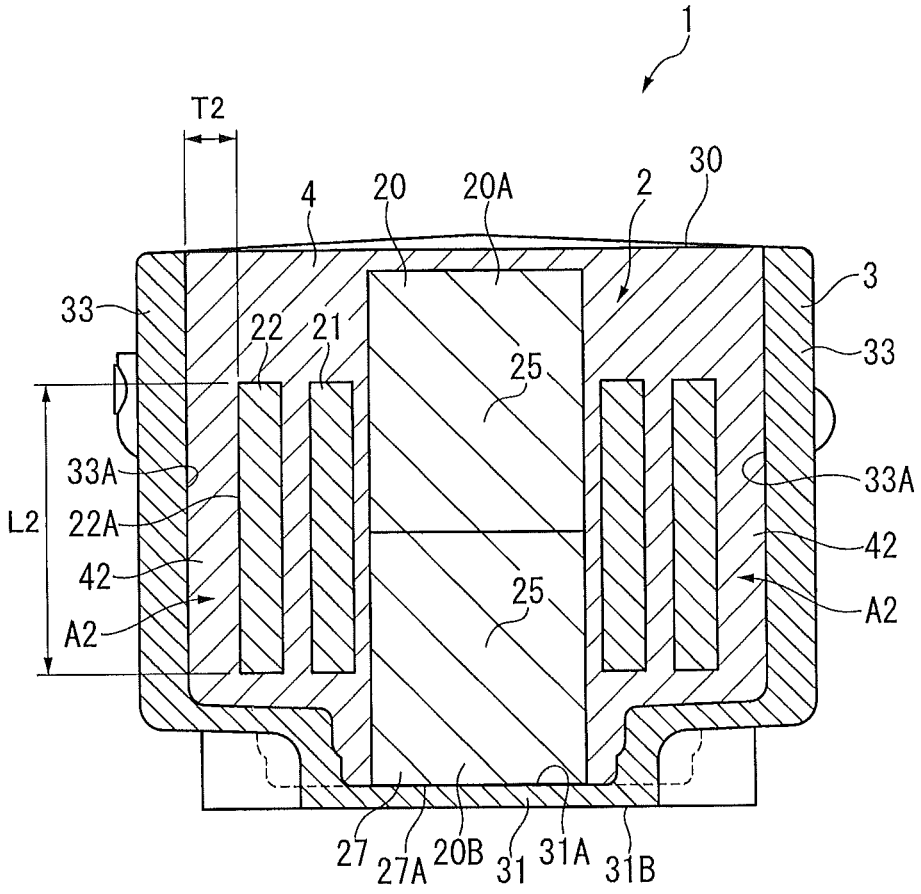
FIG. 3 is a vertical cross section of the transformer taken along line in FIG. 1.

FIGS. 2 and 3 are vertical cross sections respectively taken along II-II line and line in FIG. 1. As shown in FIGS. 1 to 3, the transformer 1 includes a sub-assembly performing a boost operation in a form of a transformer body 2 and a case 3 in which the transformer body 2 is housed. When the transformer body 2 is housed in the case 3, a clearance between the transformer body 2 and the case 3 and a void in the transformer body 2 are filled with a mold resin 4. Silicone resin is used as the mold resin 4 in the exemplary embodiment. However, the mold resin 4 may be any thermosetting fluid resin such as epoxy resin or unsaturated polyester resin.

The transformer body 2 includes a core 20 having a closed magnetic circuit structure, an input-side primary coil 21 disposed at the center of the core 20, and an output-side secondary coil 22 disposed outside the primary coil 21. The core 20 is provided by E-shaped cores 20A, 20B connected vertically in the figures. A cylindrical magnetic core 25 is provided at the center of the E-shaped cores 20A, 20B. The primary and secondary coils 21, 22 are coiled around the magnetic core 25.

Further, the E-shaped cores 20A,20B each include outer sides 26, 26 radially across the magnetic core 25. The outer sides 26, 26 and the magnetic core 25 are connected through face sections 27. The face sections 27 are narrowed at central parts thereof in a plan view at which the magnetic core 25 is provided.

Clearances are defined between the primary coil 21 and the secondary coil 22, between the primary coil 21 and the magnetic core 25, between the primary and secondary coils 21, 22 and the top and bottom face sections 27, and between the secondary coil 22 and the outer sides 26. The clearances are filled with the mold resin 4. It should be noted that, though a spacer made of glass epoxy or the like is provided for keeping the clearances, the spacer is not illustrated herein. Further, though a pair of power-input cables are connected to the primary coil 21 and a pair of power-output cables are connected to the secondary coil 22, these cables are also not shown.

The case 3 is a metal (aluminum in the exemplary embodiment) casting. The case 3 is designed in an approximately rectangular parallelepiped bottomed box having an opening 30 at an upper side thereof. Accordingly, the case 3 has a bottom portion 31 (attachment face portion) that is provided at a bottom side and is vertically opposed to the opening 30. Side walls 32 extending along short sides of the case 3 and side walls 33 extending along long sides of the case 3 are vertically provided from an outer circumference of the bottom portion 31. A narrowed portion corresponding to the core 20 is provided near the center of the bottom portion 31 (see also FIG. 6). An inner surface of the bottom portion 31 is finished to be a flat core mount surface 31A having a predetermined surface roughness smaller than that of a casting surface. The core 20 is mounted on the core mount surface 31A, where a lower surface 27A of the face section 27 defining a lower E-shaped core 20B is closely in contact with the core mount surface 31A.

On the other hand; the case 3 (transformer 1) is fixed on, for instance, a heat radiator in a form of a heat sink 7 with a bolt inserted into an attachment portion 34 provided at a lower part of the case 3. The outer surface of the bottom portion 31 of the case 3 is also finished to be a contact surface 31B that has a predetermined surface roughness and is in close contact with an upper surface of the heat sink 7. Consequently, most of the heat generated in the transformer body 2 is transferred from the face section 27 of the lower B-shaped core 20B through the bottom portion 31 of the case 3 to the heat sink 7 to be radiated thereat. It should be noted that a water-cooling heat sink having an internal cooling-water channel is suitably used as the heat sink 7. Alternatively, an air-cooling heat sink that has a heat-radiation fin and is cooled by a cooling air is also usable.

Further, in the exemplary embodiment, in order to enhance heat radiation from the transformer body 2 through the mold resin 4 and the side walls 32, 33 of the case 3 that are lateral to the transformer body 2, the following structure is adopted.

Specifically, in the cross section shown in FIG. 2, an inner wall surface 32A of the side wall 32 of the case 3 is closely opposed to an outer surface 20C (opposed surface) of the core 20 with the clearance A1 filled with a mold layer 41 of the mold resin 4 interposed therebetween. At this time, the inner wall surface 32A is parallel to the outer surface 20C for a predetermined length L1 from a point near the opening 30 of the case 3 to a point before the bottom portion 31 (from a proximity of the opening 30 to a proximity of the bottom portion 31 in the exemplary embodiment), so that a thickness T1 of the mold layer 41 in the clearance A1 stays constant.

Further, in the cross section shown in FIG. 3, an inner wall surface 33A of the side wall 33 of the case 3 is closely opposed to an outer surface 22A (opposed surface) of the secondary coil 22 with the clearance A2 filled with a mold layer 42 of the mold resin 4 interposed therebetween. At this time, the inner wall surface 33A is parallel to the outer surface 22A for a predetermined length L2 from a point near the opening 30 of the case 3 to a point before the bottom portion 31 (for an axial length of the secondary coil 22 in the exemplary embodiment), so that a thickness T2 of the mold layer 42 in the clearance A2 stays constant.

This structure is achieved by eliminating a draft in a vertical direction on the surface of a mold core used for forming the inner wall surfaces 32A,33A during the casting step of the case 3. A typical mold core includes a draft so that an area for forming the core mount surface of the case becomes smaller than an area for forming the opening. Accordingly, the draft is transcribed to the inner wall surface of the case so that a distance between the opposed inner wall surfaces is widened from the core mount surface toward the opening, so that the thickness of the side walls becomes thinner toward the opening whereas the thickness of the mold resin becomes thicker toward the opening. On the other hand, in the exemplary embodiment, since the case 3 is casted using the mold core 5 shown in FIG. 4, the thickness of the side walls 32, 33 is made constant, the thickness T1 of the mold layer 41 is made constant for the predetermined length L1 and the thickness T2 of the mold layer 42 is made constant for the predetermined length L2.

Figure 4:
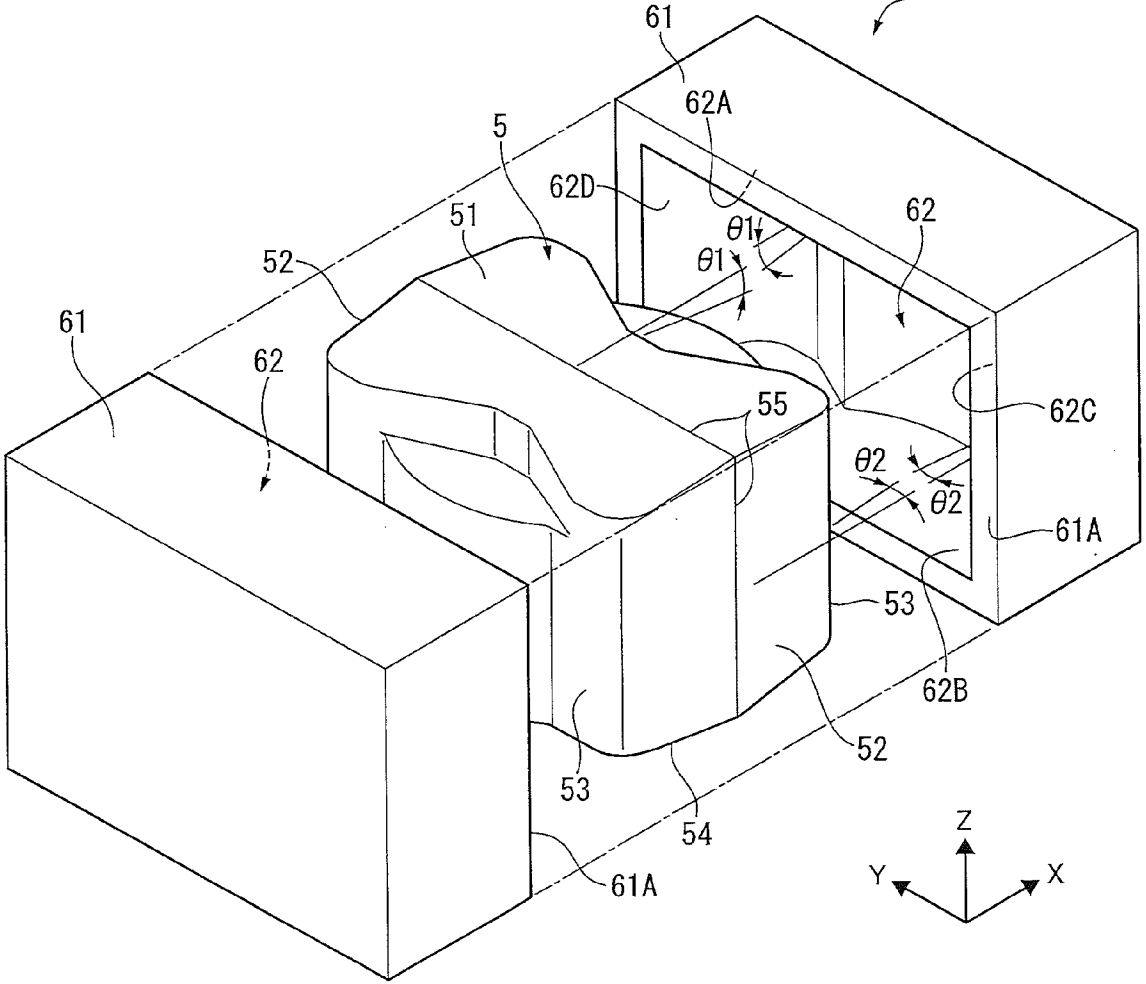
FIG. 4 is a perspective view illustrating a mold core.

FIG. 4 is a perspective view showing the mold core 5 and a mold-core-production die 6 used for producing the mold core 5.

In FIG. 4, the mold core 5 is shown to have a core mount surface forming section 51 facing upward, the core mount surface forming section 51 forming the core mount surface 31A of the case 3. Inner wall forming sections 52 for forming the inner wall surfaces 32A on the short sides of the case 3 and inner wall surface forming sections 53 for forming the inner wall surfaces 33A on the long sides of the case 3 are defined on the side surfaces of the mold core 5. The surface shown as a lower surface of the mold core 5 in FIG. 4 is an opening forming section 54 for forming the opening 30 of the case 3.

The mold core 5 is a component symmetrically bisected at a border defined by a vertical plane (i.e. YZ plane in FIG. 4) dividing the core mount surface forming section 51 and the inner wall surface forming section 52 in a right-left direction in the figure. The border appears as a parting line 55 at a position corresponding to a separation surface 61A of a pair of mold frames 61, 61 of the mold-core-production die 6. The mold frames 61 are also bilaterally symmetric. One of the mold frames 61 is drawn in +X direction in the figure and the other of the mold frames 61 is drawn in −X direction for obtaining the mold core 5.

In view of the symmetric arrangement of the mold frames 61, description will be given below on one of the mold frames 61. The mold frame 61 is provided therein with a cavity 62. The cavity 62 has a first cavity surface 62A for forming the core mount surface forming section 51 of the mold core 5, the first cavity surface 62A having a draft θ1 widening toward the separation surface 61A. Thus, the separation surface 61A is set in a direction orthogonal to the first cavity surface 62A corresponding to the bottom portion 31 of the case 3.

In addition, the draft θ1 widening toward the separation surface 61A is applied on a second cavity surface 62B for forming the opening forming section 54 (only the draft θ1 on the first cavity surface 62A is shown herein). Further, a draft θ2 widening toward the separation surface 61A is applied on each of third and fourth cavity surfaces 62C and 62D for forming a pair of the inner wall surface forming sections 52 of the mold core 5 (only the draft θ2 on the third cavity surface 62C is shown herein). The drafts θ1 and θ2 are directly transcribed onto the mold core 5 as the draft θ1 of the core mount surface forming section 51 and the draft θ2 of the inner wall surface forming section 53. The same applies to the other of the mold frames 61 and the mold core 5.

Accordingly, though the core mount surface forming section 51, the inner wall surface forming section 52 and the opening forming section 54 of the mold core 5 have drafts θ1 and θ2 inclined in X direction (i.e. a direction of short side) in FIG. 4, none of the core mount surface forming section 51, the inner wall surface forming sections 52, 53 and the opening forming section 54 has a draft inclined in Y direction (direction of long side) and Z direction (vertical direction). In other words, since the inner wall surfaces 32A, 33A of the case 3 formed by the inner wall surface forming sections 52, 53 have no draft transcribed by the mold core 5 at least in vertical direction, the thickness of the side walls 32, 33 are kept constant for the lengths L1, L2. As described above, the side walls 32, 33 are not tapered toward the opening 30, so that the thickness T1 of the mold layer 41 present between the side walls 32, 33 and the transformer body 2 becomes constant in a range of the length L1 and the thickness T2 of the mold layer 42 becomes constant in a range of the length L2.

A method for manufacturing the case 3 and a method for manufacturing the transformer 1 will be described below.

Figure 5:
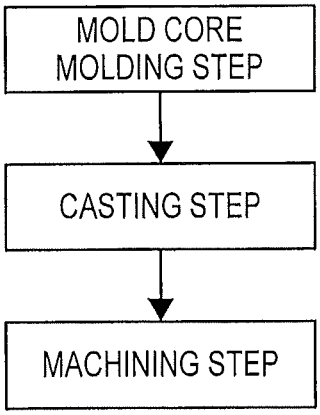
FIG. 5 is a flowchart showing a manufacturing method of a case as a component of the transformer.

Broadly speaking, the method for manufacturing the case 3 includes a mold core molding step, a casting step and a machining step as shown in FIG. 5, which are performed in this sequence for manufacturing the case 3.

In the mold core molding step, as described with reference to FIG. 4, the mold core 5 is molded using the mold-core-production die 6. Specifically, after the cavity 62 of each of the mold frames 61 is filled with molding sand and the mold frames 61 are mutually mated, only the mold frames 61 are separated to take out a sand mass, thereby obtaining the mold core 5.

In the casting step, after placing the mold core 5 inside a molding die, a molten metal (aluminum in the exemplary embodiment) is cast according to typical casting process to obtain a pre-finish case 3A.

Figure 6:
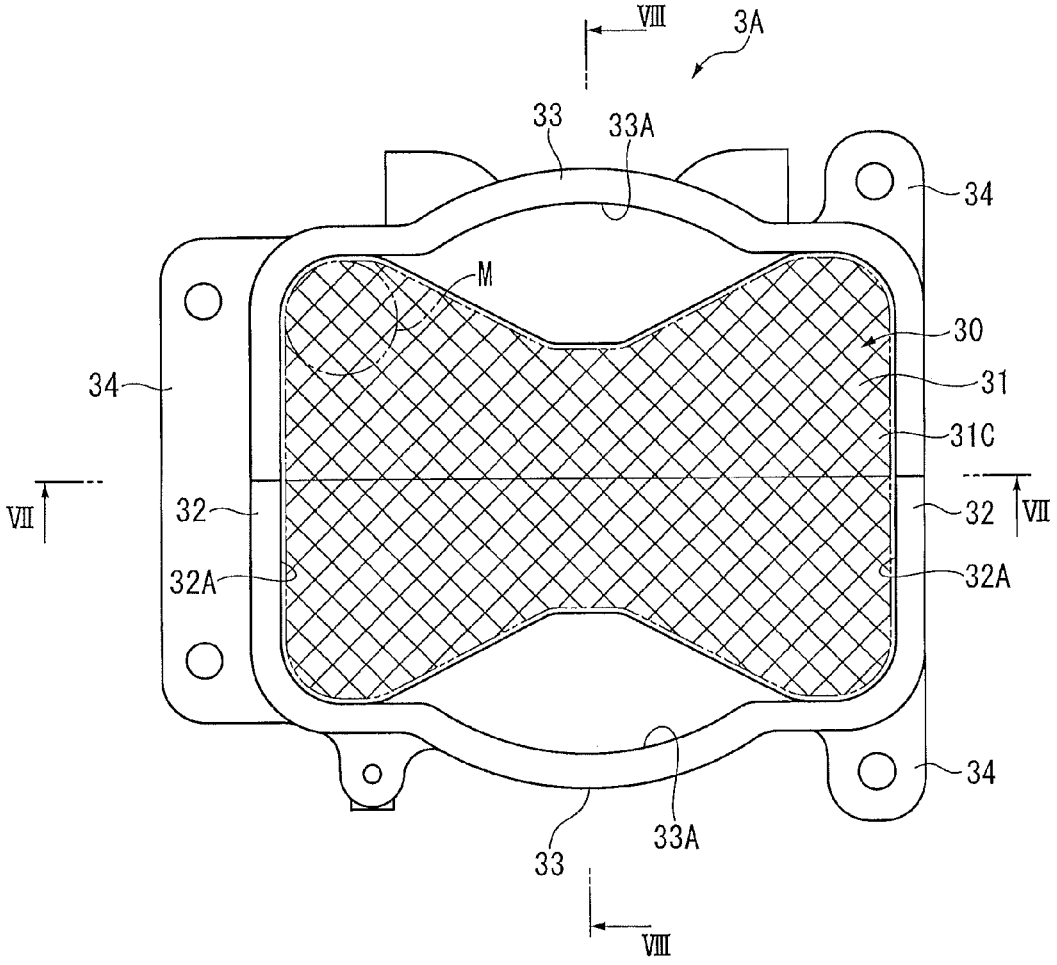
FIG. 6 is a plan view of the case illustrating a machining step.
Figure 7:
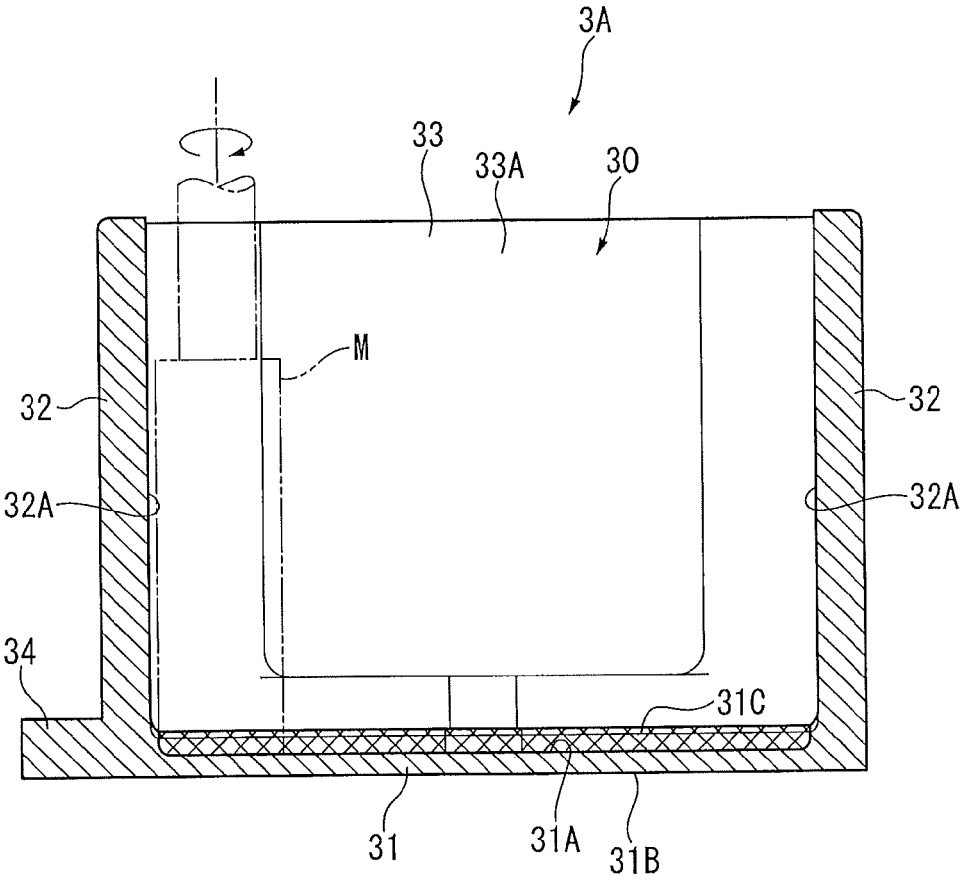
FIG. 7 is a vertical cross section of the case taken along VII-VII line in FIG. 6 illustrating the machining step.
Figure 8:
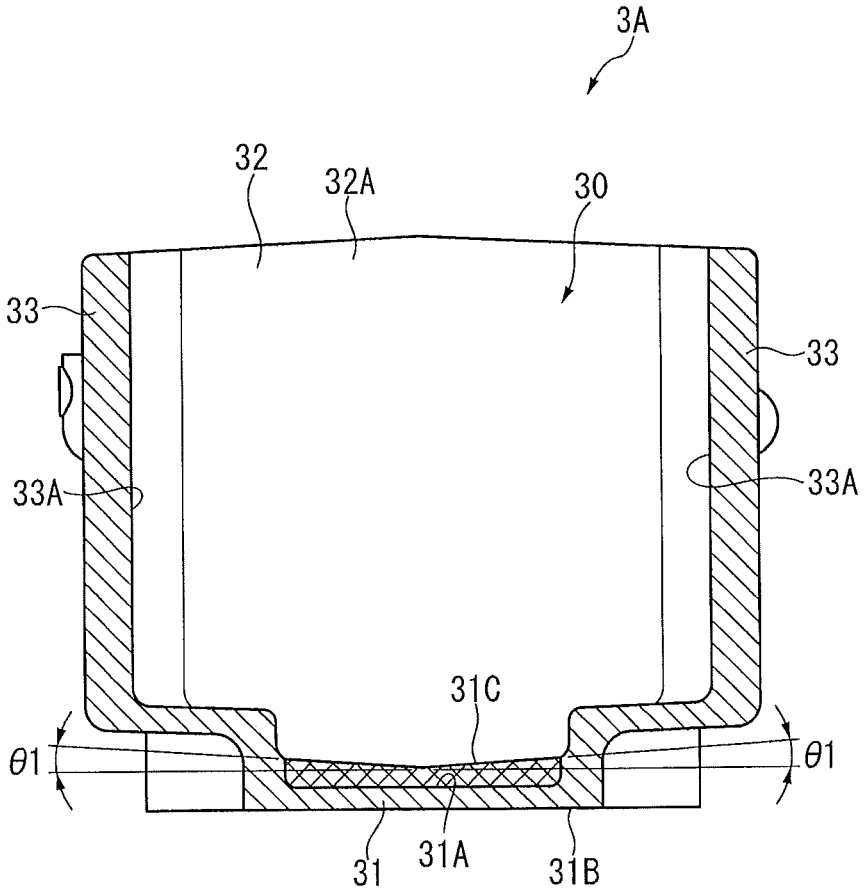
FIG. 8 is a vertical cross section of the case taken along VIII-VIII line in FIG. 6 illustrating the machining step.

The pre-finish case 3A is shown in FIGS. 6 to 8. Since the case 3A is cast using the mold core 5 having the core mount surface forming section 51 with the draft θ1, an upper surface of the bottom portion 31 of the case 3A is a casting surface 31C on which the draft θ1 is transcribed. The inclined casting surface 31C is not suitable as the core mount surface with which the core 20 of the transformer body 2 is in contact, so that some finishing step has to be performed. The finishing is performed in the next machining step.

In the machining step, a cross-hatched portion in FIGS. 6 to 8 including the casting surface 31C of the bottom portion 31 is removed by, for instance, milling using a cutting tool M (see FIGS. 6 and 7) such as an end mill. The core mount surface 31A finished to have a predetermined surface roughness is provided by the machining step. In addition, the contact surface 31B of the bottom portion 31 and the upper surface of the attachment portion 34 are also finished by machining to provide a required surface roughness. The rest of the surfaces of the case 3A is kept unmachined (i.e. stays as the casting surface).

The case 3 is manufactured after performing the above steps.

When the transformer 1 is manufactured, the transformer body 2 is initially assembled in a sub-assembly step. The transformer body 2 is then put through the opening 30 into the case 3 that is manufactured as described above, and positioned to be housed therein. Subsequently, the mold resin 4 is injected to all of the clearances including the clearances A1, A2 between the transformer body 2 and the case 3 through the opening 30 and the entirety of the assembled components is heated at a predetermined temperature to cure the mold resin, thereby holding the transformer body 2 in the case 3 by the cured mold resin 4.

It should be understood that the scope of the present invention is not limited to the above-described exemplary embodiment(s) but includes modifications and improvements as long as the modifications and improvements are compatible with the invention.

For instance, though the attachment face portion of the case of the exemplary embodiment of the invention is the bottom portion 31 of the case 3 provided at the bottom of the case 3 and the opening in the form of the opening 30 is provided at the upper side of the case 3, the attachment face portion and the opening may be provided at any position in accordance with the attitude of the case when being mounted and is not limited to the arrangement in the above exemplary embodiment.

Though the thickness of the side walls 32, 33 of the case 3 is equalized by the casting using the mold core 5 to provide a constant thickness of the mold layers 41, 42 for a predetermined length in the above exemplary embodiment, when a typical mold core is used to leave a draft on the side walls, the side of the transformer body closely facing the side walls may also be inclined to equalize the thickness of the mold layer present in the clearance between the side wall and the transformer body for a predetermined length.

Though the core mount surface 31A of the case 3 is machined to provide a predetermined surface roughness in the above exemplary embodiment, the core mount surface 31A may not be machined when the core is, for instance, brazed to be rigidly attached to the casting surface whereby the core can be favorably fixed to the case and the heat can be efficiently transferred from the core to the case.

Though the transformer 1 in the above exemplary embodiment is used for boosting, the invention is applicable to a step-down transformer.

The invention claimed is:

1. A transformer comprising:

a transformer body comprising:

a primary coil configured to receive power input, a secondary coil configured to output power, and a core around which the primary and secondary coils are coiled;

a casting case that houses the transformer body, the case being casted using a mold core; and a mold resin filling a clearance between the case and the transformer body, wherein the case comprises:

an attachment face portion on which the transformer body is attached, a side wall surrounding the attachment face portion, and an opening provided at a position opposed to the attachment face portion through which the transformer body is received into the case and the mold resin is supplied, wherein the mold core has a draft and includes side surfaces that extend along a vertical direction of the mold core, the side surfaces of the mold core defining an inner wall forming section for forming an inner wall surface of the side wall, the inner wall forming section being free of a draft that is inclined relative to a direction of a long side of the mold core and free of a draft that is inclined relative to the vertical direction of the mold core, the inner wall surface of the side wall being transcribed with any corresponding draft of the mold core, wherein a thickness of a mold layer provided in the clearance between the inner wall surface of the side wall and an opposed surface of the transformer body closely opposed to the inner wall surface is constant for a predetermined length from a point at or near the opening of the case toward the attachment face portion, and wherein a casting surface on an inner surface of the attachment face portion includes a core mount surface that is cut to have a predetermined surface roughness, the core mount surface being configured to be in contact with the core.

2. The transformer according to claim 1, wherein a casting surface on an outer surface of the attachment face portion is cut to provide a contact surface with a predetermined surface roughness, the contact surface being adapted to be in close contact with a radiator.

3. The transformer according to claim 1, wherein the case is casted using the mold core that has been manufactured using a mold-core-production die having a cavity surface corresponding to the attachment face portion of the case and a separation surface in a direction orthogonal to the cavity surface, the inner wall surface of the side wall being transcribed with any corresponding draft of the mold-core-production die.

4. A method for manufacturing a case of a transformer, the transformer comprising: a primary coil to which power is input; a secondary coil from which the power is output; a core around which the primary and secondary coils are coiled; the case that houses a transformer body provided by the primary and secondary coils and the core, the case being casted using a mold core; and a mold resin filling a clearance between the case and the transformer body, wherein the case comprises: an attachment face portion on which the transformer body is attached; a side wall surrounding the attachment face portion; and an opening provided at a position opposed to the attachment face portion, the transformer body being housed and the mold resin being supplied through the opening, the mold core having a draft and including side surfaces that extend along a vertical direction of the mold core, the side surfaces of the mold core defining an inner wall forming section for forming an inner wall surface of the side wall, the inner wall forming section being free of a draft that is inclined relative to a direction of a long side of the mold core and free of a draft that is inclined relative to the vertical direction of the mold core, a thickness of a mold layer provided in the clearance between the inner wall surface of the side wall and an opposed surface of the transformer body closely opposed to the inner wall surface being constant for a predetermined length from a point at or near the opening of the case toward the attachment face portion, a casting surface on an inner surface of the attachment face portion including a core mount surface that is cut to have a predetermined surface roughness, the core mount surface being configured to be in contact with the core, the method comprising:

manufacturing the mold core using a mold-core-production die comprising a cavity surface corresponding to the attachment face portion of the case and a separation surface in a direction orthogonal to the cavity surface; and casting the case using the mold core manufactured in the manufacturing of the mold core, the inner wall surface of the side wall being transcribed with any corresponding draft of the mold core.

5. The method for manufacturing the case according to claim 4, further comprising:

machining an inclined casting surface formed on the attachment surface of the case after the casting due to a draft which is applied on a core mount surface forming section of the mold core to remove the casting surface to provide the predetermined surface roughness.

6. The method for manufacturing the case according to claim 4, further comprising:

transcribing the inner wall surface of the side wall with a corresponding draft of the inner wall forming section of the mold core that is inclined relative to a direction of a short side of the mold core.

7. The transformer according to claim 1, wherein the inner wall surface of the side wall is transcribed with a draft of the inner wall forming section of the mold core that is inclined relative to a direction of a short side of the mold core.

* * * * *